US005815779A

United States Patent [19]

Abramsohn

[11] Patent Number: 5,815,779

[45] Date of Patent: Sep. 29, 1998

[54] SYSTEM FOR CONDITIONING LIQUID INK IN A LIQUID INK TYPE ELECTROSTATOGRAPHIC SYSTEM

[75] Inventor: Dennis A. Abramsohn, Pittsford, N.Y.

[73] Assignee: Xerox Corporation, Stamford, Conn.

[21] Appl. No.: 649,345

[22] Filed: May 17, 1996

[51] Int. Cl.[6] ..... G03G 15/00

[52] U.S. Cl. ..... 399/249; 399/296

[58] Field of Search ..... 399/233, 249, 399/250, 296; 430/97

[56] References Cited

U.S. PATENT DOCUMENTS

| | | | |
|---|---|---|---|
| 3,722,994 | 3/1973 | Tanaka et al. | 399/249 |
| 3,804,659 | 4/1974 | Sato et al. | 430/97 |
| 4,161,361 | 7/1979 | Soma et al. | 399/249 |
| 4,286,039 | 8/1981 | Landa et al. | 430/119 |
| 4,796,048 | 1/1989 | Bean | 355/3 TR |
| 5,028,964 | 7/1991 | Landa et al. | 355/273 |
| 5,276,492 | 1/1994 | Landa et al. | 355/277 |
| 5,332,642 | 7/1994 | Simms et al. | 399/250 |

*Primary Examiner*—Joan H. Pendegrass
*Attorney, Agent, or Firm*—Denis A. Robitaille

[57] ABSTRACT

A system for conditioning liquid ink made up of toner particles immersed in a liquid carrier medium being delivered to or on an image bearing surface in a multicolor electrostatographic printing machine of the type utilizing liquid developing material, particularly an image-on-image type liquid ink multicolor system. The liquid ink conditioning system includes a first member for electrostatically compressing or compacting the toner particles towards or on the image bearing surface. A second member is provided downstream from the first member for removing excess liquid from the compressed liquid ink layer. The present invention allows for a high magnitude electric potential to be applied to the first member for generating a large electric field to electrostatically compress toner particles towards or on the image bearing surface while a second member accomplishes excess liquid material removal from the liquid ink having a compressed toner layer, thereby avoiding image distortion that may accompany prior art devices which attempt to accomplish both image compaction and excess liquid removal in a single device.

12 Claims, 4 Drawing Sheets

SYSTEM FOR CONDITIONING LIQUID INK IN A LIQUID INK TYPE ELECTROSTATOGRAPHIC SYSTEM

This invention relates generally to a liquid ink-type electrostatographic printing machine, and more particularly concerns an apparatus for conditioning liquid ink, for example, a developed image on an image bearing surface in a liquid ink type multicolor electrostatographic printing machine.

Generally, the process of electrostatographic copying is initiated by exposing a light image of an original document to a substantially uniformly charged photoreceptive member. Exposing the charged photoreceptive member to light in an imagewise configuration discharges the photoconductive surface thereof in areas corresponding to non-image areas in the original input document while maintaining charge in image areas, resulting in the creation of a latent electrostatic image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a developed powder image on the photoreceptive member. Alternatively, liquid developer materials comprising a liquid carrier having toner particles immersed therein have been successfully utilized, wherein the liquid developer material is applied to the photoconductive surface with the toner particles being attracted toward the image areas of the latent image to form a developed liquid image on the photoreceptive member. Regardless of the type of developer material employed, the toner particles of the developed image are subsequently transferred from the photoreceptive member to a copy substrate, either directly or by way of an intermediate transfer member. Thereafter, the image may be permanently affixed to the copy substrate for providing a "hard copy" reproduction or print of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, as distinguished from so-called light lens generated image systems which develop toner on the charged areas, also known as CAD, or "write white" systems. The subject invention applies to both such systems.

It has become highly desirable to provide the capability of producing color output prints through the use of electrostatic printing processes. As such, a so-called subtractive color mixing process has been developed for use in electrostatographic printing machines to produce a multicolor output image, whereby a full gamut of colors are created from three colors, namely cyan, magenta and yellow. These colors are complementary to the three primary colors, with various wavelengths of light being progressively subtracted from white light.

Various methods can be utilized to produce a full process color image using cyan, magenta, and yellow toner images. One exemplary method of particular interest to the present invention for producing a process color image is described as the Recharge, Expose, and Development (REaD) process, wherein different color toner layers are deposited in superimposed registration with one another on a photoreceptive member or other recording medium to create a multilayered, multicolored, toner image thereon. In this process, the recording medium is first exposed to record a latent image thereon corresponding to a subtractive color of an appropriately colored toner particle at a first development station. Thereafter, the recording medium having the first developed image thereon is recharged and re-exposed to record a latent image thereon corresponding to another subtractive primary color and developed once again with appropriately colored toner. The process is repeated until all the different color toner layers are deposited in superimposed registration with one another on the recording medium. Variations in this general technique for forming color copies, wherein a plurality of images are formed and developed to superimpose a plurality of toner images on one another are well known in the art, and may make advantageous use of the present invention.

Using the typical electrostatographic printing process as an example, the REaD color process described hereinabove may be implemented via either of two general architectures: a single pass, single transfer architecture, wherein multiple imaging stations, each comprising a charging unit, an imaging device, and a developing unit, are situated adjacent a single photoconductive belt or drum; or a multipass, single transfer architecture, wherein a single imaging station comprising the charging unit, an imaging device, and multiple developer units are located about a photoconductive belt or drum. As the names imply, the single pass architecture requires a single revolution of the photoconductive belt or drum to produce a color image, while the multipass architecture requires multiple revolutions of the photoconductive belt or drum to produce the color print or copy. Various other techniques and systems are known and have been successfully implemented, wherein each color separation is imaged and developed in sequence. Some of such known systems require that each developing station (except the first developing station) apply toner to an electrostatic latent image over areas of toner where a previous latent image has been developed, other systems actually transfer each image over to a second image support surface prior to imaging and development of a subsequent image on the photoreceptor.

As previously noted, the use of liquid developer materials in imaging processes is well known. Likewise, the art of developing electrostatographic latent images formed on a photoconductive surface with liquid developer materials is also well known. Indeed, various types of liquid developing materials and development systems have heretofore been disclosed with respect to electrostatographic printing machines.

Liquid developers have many advantages, and often produce images of higher quality than images formed with dry toners. For example, images developed with liquid developers can be made to adhere to paper without a fixing or fusing step, thereby eliminating a requirement to include a resin in the liquid developer for fusing purposes. In addition, the toner particles can be made to be very small without the resultant problems typically associated with small particle powder toners, such as airborne contamination which can adversely affect machine reliability and can create potential health hazards. The use of very small toner particles is particularly advantageous in multicolor processes wherein multiple layers of toner generate the final multicolor output image. Further, full color prints made with liquid developers can be processed to a substantially uniform finish, whereas uniformity of finish is difficult to achieve with powder toners due to variations in the toner pile height as well as a need for thermal fusion, among other factors. Full color imaging with liquid developers is also economically attractive, particularly if surplus liquid carrier containing the toner particles can be economically recovered without cross contamination of colorants.

Liquid developer material typically contains about 2 percent by weight of fine solid particulate toner material dispersed in the liquid carrier, typically a hydrocarbon. After development of the latent image, the developed image on the photoreceptor may contain about 12 percent by weight of the particulate toner in the liquid hydrocarbon carrier. However, at this percent by weight of toner particles, developed liquid images tend to exhibit poor cohesive behavior which results in image smear during transfer and partial image removal, or socalled scavenging, during successive development steps, particularly in image-on-image color processes.

In order to prevent image scavenging and to improve the quality of transfer of the developed image to a copy sheet, the liquid ink making up the developed liquid image is typically "conditioned" by compressing or compacting the toner particles therein. This can be accomplished by either: conditioning the liquid ink making up the image into the image areas so as to physically stabilize the image on the photoreceptor or other image bearing surface; by conditioning liquid ink placed on the surface of the photoreceptor or other image bearing surface prior to the point where the image is developed with the liquid ink; or by conditioning the liquid ink stream as the ink is being delivered to the image bearing surface. Liquid ink conditioning may also include the removal of liquid carrier and preventing toner particles from departing the surface of the photoreceptor for increasing the toner solids content thereof. Such liquid ink conditioning greatly improves the ability of the toner particles to form a high resolution image on the final support substrate or an intermediate transfer member if one is employed.

Various devices and systems are known for effectively conditioning liquid inks. In one exemplary system, a single electrically conductive roller member is urged against the photoconductive member bearing a liquid developed image. The contact pressure between the roller member and the photoconductor forces liquid to be squeegeed off of the surface while an electrical bias having a potential of the same polarity as the toner in the liquid developer is applied to the roller such that the toner is repelled from the roller. By applying a biasing potential to the roller, toner particles are pushed away from the roller and into a compressed region on the surface upon which the developed image is being transported. In this type of system, the toner image may also be compacted by pressure contact of the roller against the image with the electrical bias applied to the roller repels the toner particles from the roller surface.

Although various devices have been developed for conditioning an image in liquid based electrostatographic printing systems, some problems and inadequacies remain with respect to known electrostatic based systems. Specifically, in the single biased squeegee roller arrangement of the type described above, limitations are imposed on the magnitude of the electrical bias applied to the roller due to the proximity of the roller to the photoconductive surface. In addition, because contact pressure is created between the roller and the photoconductive member, the roller profile is caused to vary which, in turn, generates variations in the electric field profile such that the electric field generated by the biased roller member is neither constant nor uniform.

The present invention is directed toward an electrostatic image conditioning device in which image compaction and liquid removal are accomplished via separate devices for independently subjecting the image to a large electric field to electrostatically compress the image and subsequently removing liquid from the compressed liquid developed image. The following disclosures may be relevant to some aspects of the present invention:

U.S. Pat. No. 4,286,039
Patentee: Landa et al.
Issued: Aug. 25, 1981
U.S. Pat. No. 4,796,048
Patentee: Bean
Issued: Jan. 3, 1989
U.S. Pat. No. 5,028,964
Patentee: Landa et al.
Issued: Jul. 2, 1991
U.S. Pat. No. 5,276,492
Patentee: Landa et al.
Issued: Jan. 4, 1994

The relevant portions of the foregoing patents may be briefly summarized as follows:

U.S. Pat. No. 4,286,039 discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 4,796,048 discloses a resilient intermediate transfer member and apparatus for liquid ink development, wherein a plurality of liquid images are transferred from a photoconductive member to a copy sheet. The liquid images, which include a liquid carrier having toner particles dispersed therein, are attracted from the photoconductive member to an intermediate belt by a biased transfer roll, such that the liquid carrier is squeezed from the intermediate belt and the toner particles are compacted thereon in image configuration. Thereafter, the toner particles are transferred from the intermediate belt to the copy sheet in image configuration with the use of another biased transfer roll.

U.S. Pat. No. 5,028,964 discloses discloses an apparatus for image transfer which comprises an intermediate transfer member and a squeegee for removing excess liquid from the toner image prior to transferring an image. The intermediate transfer member is operative for receiving the toner image therefrom and for transferring the toner image to a receiving substrate. Transfer of the image to the intermediate transfer member is aided by providing electrification of the intermediate transfer member to a voltage having the same bias as that of the charged particles. The roller is charged to a potential having the same polarity as the charge of the toner particles of the liquid developer.

U.S. Pat. No. 5,276,492 discloses an imaging method and apparatus for transferring liquid toner images from an image forming surface to an intermediate transfer member for subsequent transfer to a final substrate, wherein the liquid toner images include carrier liquid and pigmented polymeric toner particles which are essentially nonsoluable in the carrier liquid at room temperature, and which form a single phase at elevated temperatures. That patent describes a method which include the steps of; concentrating the liquid toner image by compacting the solids portion of the liquid toner image and removing carrier liquid therefrom; transferring the liquid toner image to the intermediate transfer member; heating the liquid toner image on the intermediate transfer member to a temperature at which the toner particles and the carrier liquid form a single phase; and transferring the heated liquid toner image to a final substrate.

In addition to the above cited references, it is noted that various techniques have been devised for removing excess liquid carrier from an imaging member which may involve a vacuum removal system and/or an electrical bias applied to a portion of the liquid dispersant removal device. The following references may be relevant to various aspects of the present invention.

U.S. Pat. No. 4,878,090 discloses a development apparatus comprising a vacuum source which draws air around a shroud to remove excess liquid carrier from the development zone.

U.S. Pat. No. 5,023,665 discloses an excess liquid carrier removal apparatus for an electrophotographic machine. The apparatus is comprised of an electrically biased electrode having a slit therein coupled to a vacuum pump. The vacuum pump removes, through the slit in the electrode, liquid carrier from the space between the electrode and the photoconductive member. The electrical bias generates an electrical field so that the toner particle image remains undisturbed as the vacuum withdraws air and liquid carrier from the gap.

U.S. Pat. No. 5,481,341 having a common assignee as the present application, discloses a belt used for absorbing liquid toner dispersant from a dispersant laden image on a electrostatographic imaging member or intermediate transfer member. The angle of contact of the absorption belt is adjusted with respect to the image bearing member for maintaining proper cohesiveness of the image and absorption of liquid dispersant. The absorption belt is passed over a roller biased with the same charge as the toner. A pressure roller is in contact with the absorption belt for removal of liquid therefrom.

U.S. Pat. No. 5,424,813, having a common assignee as the present application, discloses a roller comprising an absorption material and a covering, which are adapted to absorb liquid carrier from a liquid developer image. The covering has a smooth surface with a plurality of perforations, to permit liquid carrier to pass through to the absorption material at an increased rate, while maintaining a covering having a smooth surface which is substantially impervious to toner particles yet pervious to liquid carrier so as to inhibit toner particles from departing the image.

U.S. Pat. No. 5,332,642, having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

U.S. Pat. No. 5,352,558, having a common assignee as the present application, discloses a roller for removal of excess carrier liquid from a liquid developed image, comprising a rigid porous electroconductive supportive core, a conformable microporous resistive foam material provided around the core, and a pressure controller for providing a positive or negative pressure to the roller.

In accordance with one aspect of the present invention, there is provided an apparatus a system for conditioning liquid ink including toner particles immersed in a liquid carrier medium deposited on an image bearing surface. The system includes a first member for electrostatically compressing the toner particles against the image bearing surface to form a compressed liquid ink layer, and a second member for removing excess liquid from the compressed liquid ink layer without disturbing the toner particles therein.

In accordance with another aspect of the present invention, a liquid ink type electrostatographic printing machine is provided, including an system for conditioning liquid ink including toner particles immersed in a liquid carrier medium deposited on an image bearing surface, comprising: a first member for electrostatically compressing the toner particles against the image bearing surface to form a compressed liquid ink layer; and a second member for removing excess liquid from the compressed liquid ink layer without disturbing the toner particles therein.

Other aspects of the present invention will become apparent as the following description proceeds and upon reference to the drawings, in which.

Figure 3:
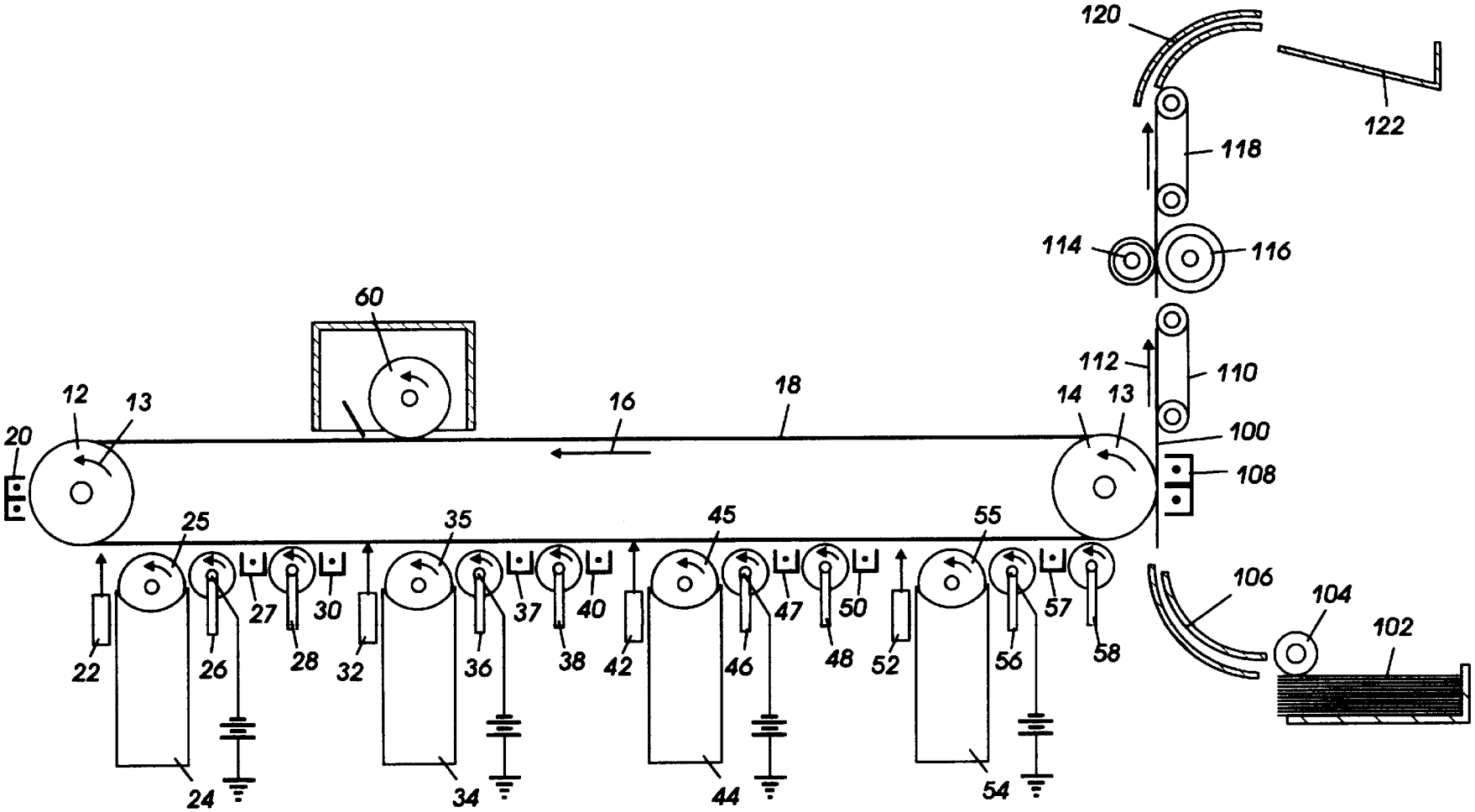
Figure 4:
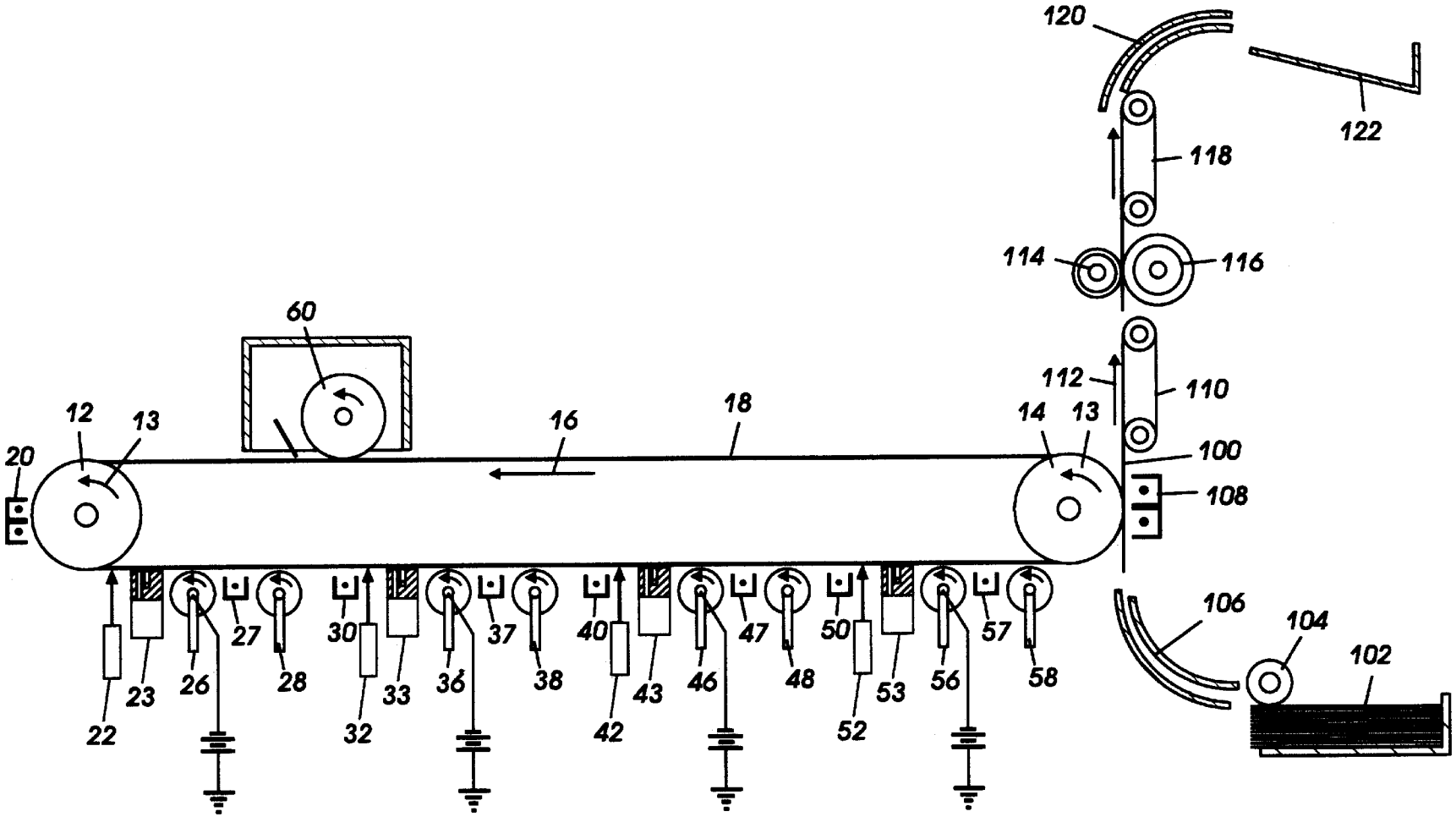

FIG. 3 is a schematic, elevational view of a liquid-based image-on-image color electrostatographic printing machine incorporating a system for conditioning a liquid ink developed image in accordance with the present invention; and FIG. 4 is a schematic, elevational view of a liquid-based image-on-image color electrostatographic printing machine incorporating a system for conditioning liquid ink in accordance with the present invention.

For a general understanding of the features of the present invention, reference is made to the drawings, wherein like reference numerals have been used throughout to designate identical elements. FIGS. 3 and 4 are schematic elevational views illustrating a full-color, liquid developing material based electrostatographic printing machine incorporating the features of the present invention. Inasmuch as the art of electrostatographic printing is well known, the various processing stations employed in the printing machine of FIGS. 3 and 4 will be described briefly with reference thereto. It will become apparent from the following discussion that the apparatus of the present invention may be equally well-suited for use in a wide variety of printing machines and is not necessarily limited in its application to the particular electrostatographic machine described herein. Moreover, while the present invention will hereinafter be described in connection with preferred embodiments thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIGS. 3 and 4, the liquid developing material based multicolor electrostatographic printing machine incorporating the features of the present invention is illustrated in schematic form. The printing machine employs a photoreceptor in the form of a continuous multilayered belt member 18, generally comprising a photoconductive surface deposited on an electrically grounded conductive substrate. The photoreceptor is entrained about rollers 12 and 14 which, in turn, are rotated in the direction of arrows 13 by some drive mechanism (not shown) for transporting the belt along a curvilinear path in the direction of arrow 16, thereby advancing successive portions of the photoreceptive belt 18 through the various processing stations disposed about the path of movement thereof.

The electrostatographic printing process is initiated by applying a substantially uniform charge potential to the photoreceptive member 18. As such, an initial processing station is shown in FIG. 3 as a charging station including a corona generating device 20 capable of applying a substantially uniform high charge potential to the surface of the photoreceptor belt 18.

After the substantially uniform charge is placed on the surface of belt 18, the electrostatographic printing process proceeds by either imaging an input document placed on the surface of a transparent imaging platen (not shown), or by providing a computer generated image signal, for selectively discharging the photoconductive surface in accordance with the image to be generated. For multicolor printing and copying, the imaging process involves separating the imaging information into the three primary colors plus black to provide a series of subtractive imaging signals, with each subtractive imaging signal being proportional to the intensity of the incident light of each of the primary colors or black. These imaging signals are then transmitted to a series of individual raster output scanners (ROSs), shown schematically by reference numerals 22, 32, 42 and 52, for generating complementary, color separated latent images on the charged photoreceptive belt 18. Typically, each ROS 22, 32, 42 and 52 writes the latent image information in a pixel by pixel manner.

In the exemplary electrostatographic system of FIG. 3, each of the color separated electrostatic latent images are serially developed on the photoreceptive belt 18 via a donor roll developing apparatus 24, 34, 44 and 54. In a typical donor roll developing apparatus, as illustrated in FIG. 3, a donor roll 25, 35, 45 or 55 is coated with a layer of appropriately colored developer material, and is rotated to transport the toner to the surface of belt 18, where the latent image on the surface of belt 18 attracts the toner thereto for producing the visible developed image. It will be understood that the developer roll can be rotated either in the same direction of travel as the photoreceptor belt 18 or opposite the direction of travel thereof, as depicted in FIG. 3. The donor roll may also be electrically biased to a suitable magnitude and polarity for enhancing the attraction of the toner particles to the latent image. Each of the developer units 24, 34, 44 and 54 shown in FIG. 3 are substantially identical to one another and represent only one of various known apparatus that can be utilized to apply developing material to the photoconductive surface or any other type of recording medium. One exemplary alternative developing system is shown in FIG. 4, wherein fountain-type developer units 23, 33, 43 and 53 are utilized for transporting liquid ink into contact with the latent image on the photoreceptor to form a liquid ink layer thereon. The latent image is subsequently developed using this liquid ink layer by means of a biased metering roll, generally identified by reference numerals 26, 36, 46 or 56. An exemplary liquid ink fountain-type device is described in commonly assigned U.S. patent application Ser. No. 08/497,990, the entire disclosure of which is incorporated by reference herein.

As previously noted, the present invention is advantageously utilized in a color electrostatographic printing system which utilizes liquid developer materials. Thus, each developing apparatus transports a different color liquid developing material into contact with the electrostatic latent image on the photoreceptor surface so as to develop the latent image with pigmented toner particles, creating a visible image. By way of example, developing apparatus 24 transports cyan colored liquid developer material, developing apparatus 34 transports magenta colored liquid developer material, developing apparatus 44 transports yellow colored liquid developer material, and developing apparatus 54 transports black colored liquid developer material. Each different color liquid developing material comprises pigmented toner particles immersed in a liquid carrier medium, wherein the toner particles are charged to a polarity opposite in polarity to the latent image on the photoconductive surface of belt 18 such that the toner particles are attracted to the electrostatic latent image to create a visible developed image thereof.

Generally, in a liquid developing material-based system, the liquid carrier medium makes up a large amount of the liquid developer composition. Specifically, the liquid medium is usually present in an amount of from about 80 to about 98 percent by weight, although this amount may vary from this range. By way of example, the liquid carrier medium may be selected from a wide variety of materials, including, but not limited to, any of several hydrocarbon liquids, such as high purity alkanes having from about 6 to about 14 carbon atoms exemplified by such commercial products as: Norpar® 12; Norpar® 13; and Norpar® 15; as well as isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons may provide a preferred liquid media since they are colorless, environmentally safe, and possess a sufficiently high vapor pressure so that a thin film of the liquid evaporates from the contacting surface within seconds at ambient temperatures.

The toner particles utilized in liquid developer compositions can be any pigmented particle compatible with the liquid carrier medium, such as, for example, those contained in the developers disclosed in U.S. Pat. Nos. 3,729,419; 3,841,893; 3,968,044; 4,476,210; 4,707,429; 4,762,764; 4,794,651; and 5,451,483, the disclosures of each of which are totally incorporated herein by reference. The toner particles should have an average particle diameter from about 0.2 to about 10 microns, and preferably from about 0.5 to about 2 microns. The toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Colombian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer materials suitable for the present invention, a charge control additive, sometimes referred to as a charge director, may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

During or after image development, the amount of liquid developing material deposited on the surface of the photoreceptor belt 18 is preferably reduced by an initial amount. To this end, with respect to the system of FIG. 3, metering rollers 26, 36, 46 and 56 are positioned slightly downstream of, and adjacent to, respective developing material applicators 25, 35, 45 and 55, in the direction of movement of the photoreceptor 18. The peripheral surface of each metering roller is situated in close proximity to the surface of the photoreceptor 18 without actually contacting the surface of the photoreceptor 18 or the developed image thereon so as to prevent blurring or distortion of the image thereby. In addition, the peripheral surface of the metering roller 26 is preferably rotated in a direction opposite the path of movement of the photoreceptor in order to create a substantial shear force against the thin layer of liquid developing material present between it and the photoreceptor 18 so as to initially reduce the amount of the liquid developing material deposited on the photoconductive surface. This shear force removes a predetermined amount of excess developing material from the surface of the photoreceptor and transports this excess developing material in the direction of the developing material applicator 25, with the excess developing material eventually falling away from the rotating metering roll 26 for collection in a sump or other liquid developer collection and reclaim system. As shown, the metering roll 26 may be electrically biased by supplying an AC or a DC voltage thereto for repelling or attracting toner particles present in the image on the photoreceptor. It will be recognized that, by providing a predetermined electrical bias at the metering roll having the same polarity as the charge on the developed image, removal of deposited toner particles from the surface of the photoreceptor due to the shear forces created by the movement of the metering roll can be inhibited. Conversely, by providing a predetermined electrical bias to the metering roll which is opposite in polarity to the charge of the developed image, background image removal can be induced, if desired. After the above metering process is completed, the developed liquid image on the photoconductor is preferably, in accordance with the present invention, further processed or "conditioned" to compress or compact the image onto the surface of the photoreceptor and to further remove some of the liquid carrier therefrom. This basic concept is shown, for example, by previously cited U.S. Pat. No. 4,286,039, among various other patents. It is noted that, with respect to the alternative system of FIG. 4, the metering process which forms the developed image in that system configuration may be accomplished after the conditioning step described herein. Thus, the conditioning system of the present invention may be utilized for conditioning a developed liquid image on a photoreceptor surface or on any surface which is used to transport a developed image (e.g. an intermediate transfer belt), or for conditioning a liquid ink layer on the photoreceptor surface or other surface, whereby the liquid ink is first subjected to a large electric field for electrostatically driving the colorant containing toner particles of the liquid ink toward the surface, followed by removal of excess liquid from the liquid ink layer on the belt surface. As such, the present invention contemplates a liquid ink conditioning system comprising a first member for electrostatically compressing the liquid ink and a second member for removing excess liquid from the compressed liquid ink layer. In either method of use, an exemplary embodiment of an ink conditioning system in accordance with the present invention is shown at reference numerals 27 and 28, wherein a corona generating device is used to electrostatically compress the liquid ink on the photoreceptor belt 18 and a squeegee roller is used to remove excess liquid from the surface of the photoreceptor belt 18. It will be recognized that various biased devices for forming high electric fields, such as an electrically biased non contact blade member, a charging "shoe", or a non-contact biased roller, can also be used as an alternative to the described corona generating device. The detailed structure of various embodiments of the ink conditioning system of the present invention, whether utilized in the configuration of FIG. 3 or 4, and alternative embodiments thereof, as well as the operation thereof will be described hereinafter with reference to FIGS. 1 and 2.

Continuing with a general description of the multicolor liquid electrostatographic printing process, following the ink conditioning, belt 18 continues to advance in the direction of arrow 16 to a recharge station where yet another corona generating device 30 is utilized to recharge the photoconductive surface of belt 18 to a substantially uniform potential. Thereafter, the belt continues to travel to the next exposure station, where ROS 32 selectively dissipates the charge laid down by corotron 30 to record another color separated electrostatic latent image corresponding to regions to be developed with a magenta developer material. This color separated electrostatic latent image may be totally or partially superimposed on the cyan image previously developed on the photoconductive surface. Thereafter, the electrostatic latent image is advanced to the next successive developing apparatus 34 which deposits magenta toner thereon.

After the electrostatic latent image has been developed with magenta toner, the photoconductive surface of belt 18 continues to be advanced in the direction of arrow 16 to the next metering roll 36, to the next image conditioning station 37, 38 and onward to corona generating device 40, which, once again, charges the photoconductive surface to a substantially uniform potential. Thereafter, ROS 42 selectively discharges this new charge potential on the photoconductive surface to record yet another color separated electrostatic latent image, which may be partially or totally superimposed on the prior cyan and magenta developed images, for development with yellow toner. In this manner, a yellow toner image is formed on the photoconductive surface of belt 18 in superimposed registration with the previously developed cyan and magenta images. It will be understood that the color of the toner particles at each development station may be provided in an arrangement and sequence that is different than described herein.

After the yellow toner image has been formed on the photoconductive surface of belt 18, the belt 18 continues to advance to the next metering roller 46, image conditioning station 47, 48 and onward to recharge station 50 and corresponding ROS 52 for selectively discharging those portions of belt 18 which are to be developed with black toner. In this final development step, black images are developed via a process known as black undercolor removal process, wherein the developed image is located only on those portions of the photoconductive surface adapted to have black in the printed page and may not be superimposed over the prior cyan, magenta, and yellow developed images. This final developed image is once again metered and image conditioned at an image conditioning station 57, 58 to compact the image and subsequently remove excess liquid from the image.

Using the process described hereinabove, a composite multicolor toner image is formed on the photoconductive surface of belt 18. It will be recognized that the present description is directed toward a Recharge, Expose, and Develop (REaD) process, wherein the charged photoconductive surface of photoreceptive belt 18 is serially exposed to record a series of latent images thereon corresponding to the subtractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD), wherein discharged portions are developed, or charged area development (CAD), wherein charged areas are developed can be employed, as will be described.

After the composite multicolor image is formed on the photoreceptor, the multilayer developed image may be further conditioned with corona and/or light and then. advanced to a transfer station, whereat a sheet of support material 100, typically a sheet of paper or some similar sheetlike substrate, is advanced from a stack 102 by a feed roll 104. The sheet advances through a chute 106 and is guided to the transfer station at which a corona generating device 108 directs ions onto the back side of the support material 100 for attracting the composite multicolor developed image on belt 18 to the support material 100. While direct transfer of the composite multicolor developed image to a sheet of paper has been described, one skilled in the art will appreciate that the developed image may be transferred to an intermediate member, such as a belt or drum, and then, subsequently, transferred and fused to the sheet of paper, as is well known in the art.

After the image has been transferred to the support substrate, the conveyor belt 110 moves the sheet of paper in the direction of arrow 112 to a drying or fusing station. The fusing station includes a heated roll 114 and back-up or pressure roll 116 resiliently urged into engagement with one another to form a nip through which the sheet of paper passes. The fusing station operates to affix the toner particles to the copy substrate so as to bond the multicolor image thereto. After fusing, the finished sheet is discharged onto a conveyor 118 which transports the sheet to a chute 120 and guides the sheet into a catch tray 122 for removal therefrom by the machine operator.

Often, after the developed image is transferred from belt 18, residual developer material tends to remain, undesirably, on the surface thereof. In order to remove this residual toner from the surface of the belt 18, a cleaning roller 60, typically formed of an appropriate synthetic resin, is driven in a direction opposite to the direction of movement of belt 18 for contacting and cleaning the surface thereof. It will be understood that a number of photoconductor cleaning means exist in the art, any of which would be suitable for use with the present invention.

The foregoing discussion provides a general description of the operation of a liquid developing material based electrostatographic printing machine incorporating the image conditioning system of the present invention therein. The detailed structure of the image conditioning system will be described hereinafter with reference to FIGS. 1 and 2.

Figure 1:
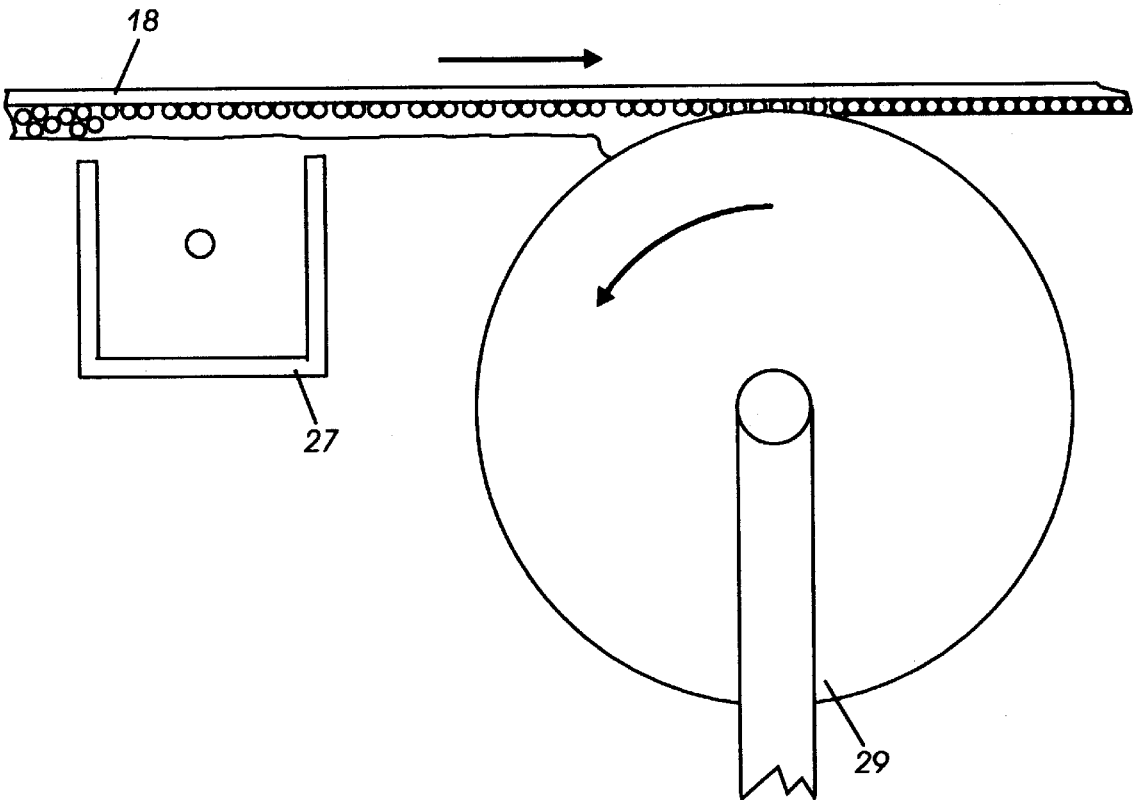
FIG. 1 is a schematic elevational view of one embodiment of a system for conditioning liquid ink in accordance with the present invention.

Referring now to FIG. 1 a first embodiment of the image conditioning system in accordance with the present invention will be described with an understanding that the image conditioning systems shown in the multicolor electrostatographic printing system of FIG. 3, identified by reference numerals 27,28; 37,38; 47,48; and 57,58, are substantially identical thereto. In general, the only major distinction between each image conditioning system is the color of the liquid developed image being conditioned with minor distinctions possibly being found in spacing and voltage levels due to toner pile height differences.

As depicted in FIG. 1, the preferred embodiment of the image conditioning system in accordance with the present invention includes a non-contacting electrostatic device such as a corona generating device 27 of the type well known in the art or any other noncontacting high electric field generating device including an electrically biased blade, plate or shoe, a charged roller member, or a thin electrode having a bias voltage applied thereto. The high electric field generating device is preferably situated adjacent to, and in close proximity (approximately 2 to 4 mils) to the surface of photoreceptive belt 18 so as to be maintained in a non-contacting position relative to the liquid ink on the photoreceptor surface 18. One exemplary high electric field generating device 27 includes a low air ionization conductive corona generating electrode 70 having a diameter in the range of 3–5 mils coupled to an electrical biasing source 72, preferably applying a voltage potential in the range of 5000 to 7000 volts to the conductive electrode, relative to the conductive ground plane of the photoreceptor. This biasing potential has a polarity identical to the polarity of the charged toner particles in the liquid developed image, for generating a large electric field and same polarity charge flow across the gap between the electrode and the image bearing surface of the photoreceptor belt 18, thereby repelling the same polarity charged toner (represented by small circles) in the direction of the photoconductor surface. Thus, as can be seen from FIG. 1, the corona generating device 27 causes the toner particles, which are dispersed throughout the layer of liquid developing material on the photoreceptor, to be compacted or compressed into a thin layer immediately proximate to the surface of the photoreceptor surface.

After the toner particles have been compacted, the liquid ink layer may be then further conditioned to remove excess liquid carrier from the developed image on the photoreceptor. In the preferred embodiment of FIG. 1, this excess liquid removal step is executed by means of a moving contact member 28 for contacting the surface of the liquid layer to push, wipe, blot, absorb, vacuum or otherwise remove the excess liquid from the surface of the photoreceptor without disturbing the electrostatically compressed image. One exemplary contact member known in the art for removing excess liquid carrier is disclosed in U.S. Pat. No. 4,286,039, wherein a deformable polyurethane roller is provided in the from of a squeegee roller for pushing or wiping much of the liquid carrier of the liquid developer from the surface of the photoconductor. As shown in that patent, the contact roller member may also be biased by an electrical potential having a sign the same as the sign of the charged toner particles in the liquid developed image for repelling the toner particles from the surface of the roller to prevent streaking, smearing, tailing or distortion of the developed liquid electrostatic image.

Alternatively, a porous blotter in the form of an absorbent roller or belt may be positioned in contact with the photoconductive member carrying the developed liquid image. One exemplary porous blotter system known in the art which may be effectively used to condition an image formed from a liquid developer is a vacuum assisted blotter roller of the type generally disclosed in commonly assigned U.S. Pat. No. 5,332,642, wherein a negative pressure vacuum absorption system is used to draw off liquid carrier dispersant such as Isopar through an absorbent material which, in turn, removes excess carrier liquid from the developed toner image on the photoconductor, or on any developed liquid image bearing surface, including an intermediate transfer member.

Several advantages over other methods of liquid reduction found in the prior art have been found in eliminating excess liquid carrier by vacuuming the liquid through a roller member, belt, or other contact member. For example, in a vacuum based system, less dispersant evaporates into the atmosphere, thus reducing pollution and potential health risks to individuals working near the machine. In addition, since the liquid carrier can be reclaimed and reused, an efficient vacuum type blotter roller can yield cost advantages. Furthermore, a potential exists for the removed liquid to return back to the image bearing surface from the contact member which may be eliminated through the use of a vacuum based system, thereby eliminating potential disturbance of the image such that the final output image tends to be more clearly defined.

In the case of either a squeegee or a blotter contact member, the roller or other contact member may be advantageously made to be electroconductive, wherein an electrical biasing potential of the same sign polarity as the toner in the liquid developer is applied to the contact member such that the toner so is repelled from the contact member. By applying a bias potential to the roller, toner particles are prevented from moving toward the contact member so that the toner particles remain in tact with the image areas of the latent image. Furthermore, the toner image may be further compacted by the bias and/or pressure contact of the contact member.

Figure 2:
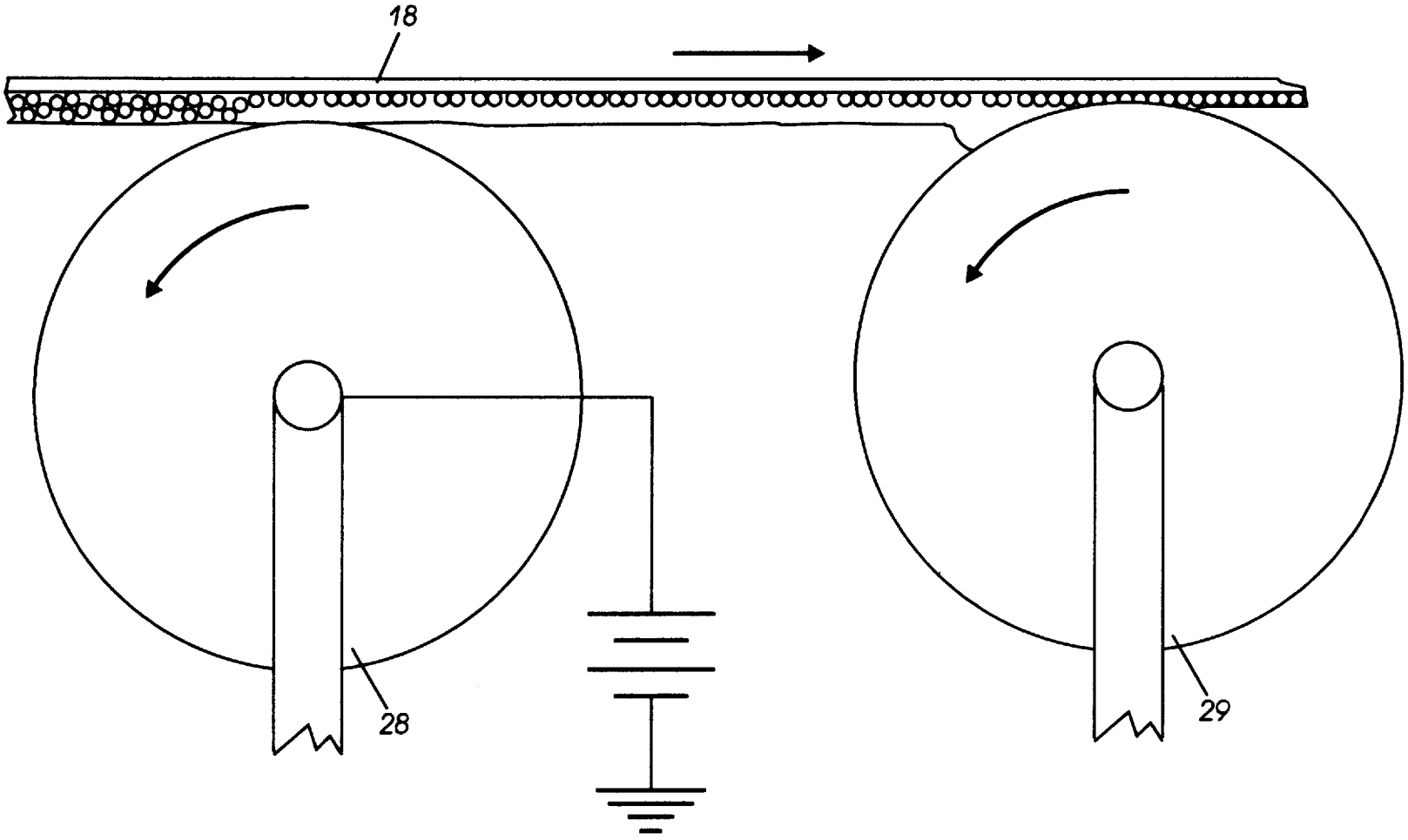
FIG. 2 is a schematic elevational view of a second embodiment of a system for conditioning liquid ink in accordance with the present invention.

An alternative embodiment of the dual member liquid ink conditioning system of the present invention is shown in FIG. 2. In this embodiment, the corona generating device 27 of the embodiment shown in FIG. 1 is replaced with a known biased induction charge generating member such as a conductive shoe, blade member or a roller member, as illustrated, akin to a bias charging roller or a bias transfer roller as are well known in the art. The biased induction charge generating member 28 is coupled to an electrical biasing source 172 and placed proximate to the liquid ink layer for providing a high field region for compacting or compressing the toner particles against the surface of the photoreceptor. This first station, namely the induction charge generating member 127 does not contact the liquid developed image and does not remove any excess liquid therefrom. As a result, the electrical bias applied to the roller member 127 may vary, on the order of many thousands of volts, and preferably in the range of 2000–5000 volts, thereby permitting extraordinary electrostatic compaction of the toner particles. A second station, including a contact member such as a squeegee or blotter roll, as previously described, is provided downstream from the first station for removing excess liquid from the liquid ink while further compacting the toner particles onto the image areas. Thus, the embodiment of FIG. 2 operates in the same manner of the embodiment of FIG. 1 in that a first member is provided for compressing or compacting the toner particles against the surface of the photoreceptor while a second member is provided downstream from the first member for removing excess liquid from the compressed ink layer.

In review, the present invention provides a system conditioning liquid ink being delivered to or on an image bearing surface in a liquid ink type multicolor electrostatographic printing machine, particularly an image-on-image type multicolor machine. The ink conditioning system includes a first member is provided for electrostatically compressing or compacting the toner particles towards or against the surface of the photoreceptor while a second member is provided downstream from the first member for removing excess liquid from the compressed ink layer. The present invention allows for a high magnitude electric potential to be applied to the first member for generating a large electric field to electrostatically compress toner particles in the liquid ink while a second member accomplishes excess liquid material removal from the liquid ink having a compressed toner layer, thereby avoiding image distortion that may accompany prior art devices which attempt to accomplish both image compaction and excess liquid removal in a single device.

It is, therefore, apparent that there has been provided, in accordance with the present invention, a system for conditioning liquid ink on an image bearing surface in a liquid ink type multicolor electrostatographic printing machine, particularly an image-on-image type multicolor machine. The method and apparatus described herein fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. A system for conditioning a liquid ink layer including charged toner particles of a selected charge polarity immersed in a liquid carrier medium delivered to an image bearing surface, comprising:

a first member, including a corona generating device, for applying a charge of the same charge polarity of the charged toner particles to the liquid ink layer to electrostatically compress the toner particles towards the image bearing surface, forming a compressed liquid ink layer thereon; and a second member, including a contact member, for contacting the compressed liquid ink layer to remove excess liquid from the compressed liquid ink layer without disturbing the toner particles therein.

2. The system of claim 1, wherein said contact member includes a deformable squeegee roller for pushing the excess liquid of the compressed liquid ink layer from the image bearing surface.

3. The system of claim 1 wherein said contact member includes a porous blotter member for absorbing the excess liquid of the compressed liquid ink layer from the image bearing surface.

4. The system of claim 3, wherein said porous blotter member includes an absorbent roller member.

5. The system of claim 3, further including a vacuum member coupled to said blotter member for providing a negative pressure vacuum absorption system to draw the excess liquid from the compressed liquid ink layer through the blotter member.

6. The system of claim 1, further including an electrical potential biasing source coupled to said contact member, said electrical potential biasing source providing an electrical bias having a same polarity as a polarity of the toner particles in the liquid ink for repelling the toner particles from the contact member to prevent distortion of the compressed liquid ink layer.

7. A liquid ink type electrostatographic printing machine including a system for conditioning liquid ink including toner particles immersed in a liquid carrier medium deposited on an image bearing surface, comprising:

a first member, including a corona generating device, for applying a charge of the same charge polarity of the charged toner particles to the liquid ink layer to electrostatically compress the toner particles against the image bearing surface, forming a compressed liquid ink layer thereon; and a second member, including a contact member, for contacting the compressed liquid ink layer to remove excess liquid from the compressed liquid ink layer without disturbing the toner particles therein.

8. The electrostatographic printing machine of claim 7, wherein said contact member includes a deformable squeegee roller for pushing the excess liquid of the compressed liquid ink layer from the image bearing surface.

9. The electrostatographic printing machine system of 7, wherein said contact member includes a porous blotter member for absorbing the excess liquid of the compressed liquid ink layer from the image bearing surface.

10. The electrostatographic printing machine of claim 9, wherein said porous blotter member includes an absorbent roller member.

11. The electrostatographic printing machine of claim 9, further including a vacuum member coupled to said blotter member for providing a negative pressure vacuum absorption system to draw the excess liquid from the compressed liquid ink layer through the blotter member.

12. The electrostatographic printing machine of claim 7, further including an electrical potential biasing source coupled to said contact member, said electrical potential biasing source providing an electrical bias having a same polarity as a polarity of the toner particles in the liquid ink for repelling the toner particles from the contact member to prevent distortion of the compressed liquid developed image.

* * * * *